United States Patent [19]

Hensler

[11] 4,193,215

[45] Mar. 18, 1980

[54] FASTENER FOR INSTEP PORTION OF SKI SHOE

[75] Inventor: Adolf Hensler, Koflach, Austria

[73] Assignee: Koflach Sportgerate Gesellschaft m.b.H., Koflach, Austria

[21] Appl. No.: 923,444

[22] Filed: Jul. 10, 1978

[51] Int. Cl.[2] ..... A43B 11/00; A43B 5/04

[52] U.S. Cl. ..... 36/50; 36/117; 24/258; 24/270

[58] Field of Search ..... 36/50, 117–121; 24/258, 270, 271, 273

[56] References Cited

U.S. PATENT DOCUMENTS

| | | | |
|---|---|---|---|
| 3,668,791 | 6/1972 | Salzman et al. | 36/50 |
| 3,842,394 | 10/1974 | Bolduc | 24/258 X |
| 3,883,964 | 5/1975 | Check | 36/119 |

FOREIGN PATENT DOCUMENTS

| | | | |
|---|---|---|---|
| 2709694 | 9/1977 | Fed. Rep. of Germany | 36/117 |

*Primary Examiner*—James Kee Chi

*Attorney, Agent, or Firm*—Cushman, Darby & Cushman

[57] ABSTRACT

Shoe, particularly ski shoe, with a cup covering the front part of the foot and having a slot in the area of the instep, the edges of which slot can be pressed against each other by means of a tightening device, characterized by the fact that the tightening device has a pulling element going through the two slot edges which rests against the cup at the inner side of the cup edge being placed in the inside and is connected with a tightening element resting against the outer side of the outer cup edge and that an instep plate is connected with the pulling element in such a manner that its level is adjustable.

9 Claims, 3 Drawing Figures

FASTENER FOR INSTEP PORTION OF SKI SHOE

Figure 1:
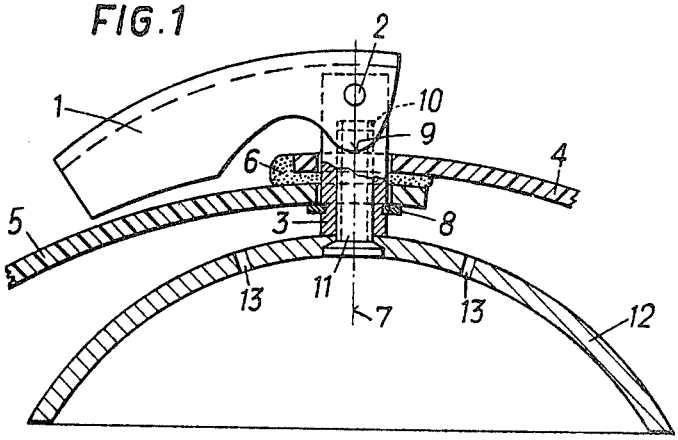

The invention refers to a shoe, particularly a ski shoe, with a cup covering the front part of the foot and the area of the instep having a slot. In the case of cups for ski shoes, where it is possible to get into them by folding down a part of the cup arranged in the area of the Achilles' tendon, it is generally customary to design the cup with a cap curving around the heel and in the case of such cups, it is not possible, for technical reasons in connection with the molding, to design the cup without a slot in the area of the instep because the mold would have to be too expensive and complicated in this case. In the case of cups with a slot in the area of the instep, it is customary to close this slot by means of tightening devices which have pulling elements to get the one edge of the slot to the other edge of the slot in tangential direction to the surface of the cup. Tightening devices equipped with such pulling elements result in a pivoting of the parts of the cup around their bases at the sole owing to the kinematics of the closing and, therefore, as a rule, a lateral pressure is exerted on the foot with such a closing. In spite of the use of padded inner shoes, it proved that such cups offer only a lesser comfort with feet of different shapes, particularly due to the swelling of the feet as it occurs in the course of the day.

It has been the task of the invention under consideration to avoid these disadvantages and it consists essentially of the fact that the edges of the slot can be pressed against each other by means of at least one tightening device and that a curved plate is provided in the inside of the cup which is connected with the tightening device in such a manner that its height is adjustable. Owing to the fact that the edges of the slot are pressed against each other by the tightening device, a lateral pressure is avoided on the foot and the shape of the cup is not changed by the closing of the slot. However, in order to permit the inner space of the cup to adapt to an inner shoe by taking into account the respective requirements, a curved plate is provided which is connected with the tightening device in such a way that its height is adjustable. By respectively adjusting the height of this plate, the optimum fit of the foot or of the inner shoe can always be guaranteed and, by means of this plate, it can be taken into account that the foot itself is subject to fluctuations in the course of the day as to its outer dimensions. An unpleasant pressure on the foot can be definitely avoided by means of the use of a curved plate.

In accordance with a preferred design of the shoe according to the invention, it is formed in such a manner that the tightening device has a swiveling lever with pressure surfaces eccentric to the swiveling axis of the lever which interact with the cup towards the one side of the slot or with a part connected with the cup. Preferably the lever is hinged diagonally to the axis of the sleeve and the sleeve goes through both limiting edges of the slot, whereby the edges of the cup, i.e. the shell of the shoe, limiting the slot are on top of each other and in axial direction of the sleeve, and the sleeve has projections directed radially to the axis of the sleeve which go behind the lower edge of the cup limiting the slot. In this way both edges of the slot are pressed to each other in axial direction. When the slot provided in the instep area of the cup is closed by pressing the edges in axial direction of the sleeve, no swiveling around a thought axis in the sole plane is given and no lateral pressure on the inner shoe or foot, respectively, is exerted.

In accordance with a preferred form of execution of the invention the sleeve shows an internal thread whereby the plate is connected in a turn-safe manner by at least one bolt having an external thread and being screwed into the sleeve. In such execution, adjusting of the height of the plate is possible in a simple manner by opening the tightening lever whereby turning the tightening lever around the axis of the sleeve is possible. By turning the sleeve with the tightening lever, the bolt bearing the plate is screwed, more or less far, out of the internal thread in axial direction of the sleeve and the height chosen at any time is fixed after closing the tightening lever, whereby an accidental and unintended turning and alteration of the height cannot occur after closing the lever. The bolt is preferably hinged to the plate in this way that that the plate can be well adjusted to the instep form of the wearer's foot. However, the execution can also be in such a way that the plate at its surface towards the cup is provided with a lining of elastic material. By means of such lining the inclination of the plate can be fixed in a simple manner taking into account various instep forms of various wearers of the shoe. To have an irreproachable tightening of the slot, an elastic packing material is provided in a simple manner between the edge of the cup limiting the slot.

The invention is hereafter explained by means of execution examples shown in the drawing.

Figure 2:
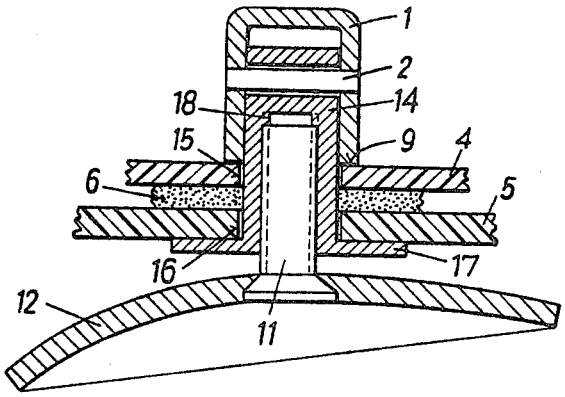
Figure 3:
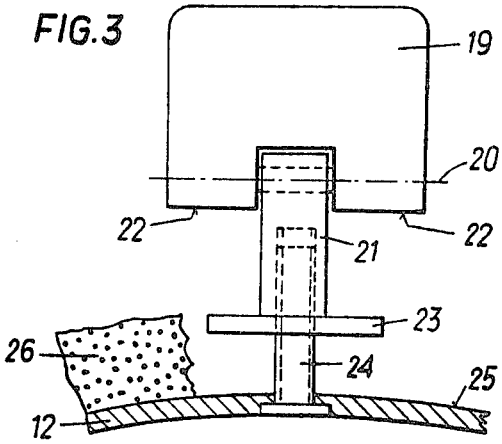

FIG. 1 shows a section through the instep area of the cup,

FIG. 2 a section of another execution form of the invention in a normal plane to the section of FIG. 1 and FIG. 3 a section through another execution form of the invention in an analogous manner to FIG. 2, in which for clearness' sake, the edges limiting the slot of the cup are not shown.

A lever is given the number 1 in FIG. 1 which is connected to a sleeve 3 in such a way that it can be pivoted around an axle 2. The sleeve 3 extends through the edges 4 and 5 limiting the slot of the cup. The number 6 indicates packing material arranged between the edges of the cup 4 and 5. The sleeve 3 goes through the edges 4 and 5 of the cup and behind the lower part of the cup, in the direction of the axle 7 of the sleeve, with a ring-shaped projection 8 which is rigidly fixed at the sleeve 3 in the direction of the axis 7 of the sleeve 3. The lever 1 has pressure surfaces 9 eccentric to the swiveling axle 2 at its side towards the edge 4 of the cup. When the lever 1 is in the position as shown in FIG. 1, which is the closing position, the edge 4 of the cup is pressed against the edge 5 of the cup, which is engages from below by the projection 8, with the help of the pressure surfaces 9.

The sleeve 3 has an internal thread 10 into which a bolt 11 is screwed. This bolt 11 is connected with a curved plate 12 in such a manner that it is turn-safe. Near the rigid connection with the bolt 11, the plate 12 has perforations 13 which give flexibility to the plate 12 vis-a-vis the axis of the bolt 11. In this instance, the plate 12 can itself consist of elastic material. When, according to the example of a design as shown in FIG. 1, the lever 1 is moved into the open position, the pressure surfaces 9 are disengaged from the edge 4 of the cup and the turning of the sleeve around the axis 7 is permitted. With this turning, the plate 12 is screwed out of the sleeve or screwed into the sleeve in the direction of the axis 7 since the bolt 11 is rigidly connected with the plate 12. After having fastened the lever 1, the respective, adjusted level of plate 12 is fixed.

The only difference in FIG. 2 is the sleeve 14 which differs from the sleeve 3 shown in FIG. 1. The remaining references are the same as in FIG. 1. This sleeve 14 is put through the perforations 15 and 16 of the parts 4 and 5 of the cup and engages from below the perforation 16 in part 5 of the cup with an annular flange 17. In the same manner as in FIG. 1, the bolt 11, connected in a turn-safe manner with the plate 12, is screwed into the internal thread 18 of this sleeve 14. In FIG. 3, a tension lever 19 is hinged at a sleeve 21 which can be pivoted around an axis 20. This lever 19 has pressure surfaces 22 at its lower side towards the shoe surface whereby the edges 4 and 5 of the cup are not shown in this FIG. 3 in order to give a clearer picture. The flange 23 goes behind the lower part of the edge of the cup which is not shown. In a similar manner as in the preceding Figures, a bolt 24 is screwed into the sleeve 21 which is connected in a turn-safe manner with the plate 12. The method of operation of the design according to FIG. 3 is, in this instance the same as the method of operation of the designs according to FIGS. 1 and 2. The plate 12 can be made of any elastic material, for example, also of spring steel. Preferably, this plate consists of aluminum. Padding 26 made of foam material can be arranged on the upper side 25 of the plate 12 towards the cup which would have an effect on the inclination of the plate 12 inside the cup.

I claim:

1. In a ski shoe construction: a cup portion which in use covers the front part of the foot, said cup having a slot overlying the instep of the foot and formed by overlapping upper and lower edge portions of the cup; a pulling element passing through said upper and lower edge portions of said slot in a direction perpendicular to the planes of said edge portions, said pulling element having an upwardly facing surface engaging said lower edge portions; and a tightening element arranged outwardly of said upper edge portion and cooperating with said pulling element and with said upper edge portion to releasably clamp said upper and lower edge portions together in a direction perpendicular to the planes of said edge portions whereby said clamping does not result in movement of said edge portions in their planes.

2. A ski shoe as in claim 1 wherein said pulling element is a sleeve and said tightening element is a lever pivoted to the outer end of said sleeve for swinging movement about an axis perpendicular to the axis of the sleeve, said lever having a pressure surface offset from the pivot axis for engagement with said upper edge portion.

3. A ski shoe as in claim 1 or 2 including an instep plate arranged below said slot and adjustment means connecting said instep plate to said pulling element for adjusting said instep plate toward and away from said slot in a direction perpendicular to the planes of said edge portions.

4. In a ski shoe construction: a cup portion which in use covers the front part of the foot, said cup having a slot overlying the instep of the foot and formed by overlapping upper and lower edge portions of the cup; a pulling element passing through said upper and lower edge portions of said slot in a direction perpendicular to the planes of said edge portions, said pulling element having an upwardly facing surface engaging said lower edge portions; a tightening element arranged outwardly of said upper edge portion and cooperating with said pulling element and with said upper edge portion to releasably clamp said upper and lower edge portions together in a direction perpendicular to the planes of said edge portions whereby said clamping does not result in movement of said edge portions in their planes; an instep plate arranged below said slot; and adjustment means connecting said instep plate to said pulling element for adjusting said instep plate toward and away from said slot in a direction perpendicular to the planes of said edge portions.

5. A ski shoe as in claim 4 wherein said pulling element is a sleeve and said tightening element is a lever pivoted to the outer end of said sleeve for swinging movement about an axis perpendicular to the axis of said sleeve, said lever having a pressure surface offset from the pivot axis for engagement with said upper edge portion, and wherein said adjustment means is a bolt attached to said instep plate in a manner to prevent rotation of said bolt about its axis, said bolt threadedly engaging a threaded bore in said sleeve.

6. A ski shoe as in claim 4 or 5 wherein the upwardly facing surface on said bolt is formed by at least one radial projection on said bolt, said surface bearing against the lower surface of said lower edge portion.

7. A ski shoe as in claim 4 or 5 wherein said bolt is attached to said instep plate by a hinge.

8. A ski shoe as in claim 7 including a lining of elastic material provided on the surface of said instep plate which faces said slot.

9. A ski shoe as in claim 7 including a layer of elastic packing arranged between said overlapping edge portions.

* * * * *